United States Patent [19]

Sanford et al.

[11] 4,338,956

[45] Jul. 13, 1982

[54] CIGARETTE FILTER

[75] Inventors: Robert A. Sanford, Prospect; Robert R. Johnson, Louisville, both of Ky.

[73] Assignee: Brown & Williamson Tobacco Corporation, Louisville, Ky.

[21] Appl. No.: 213,441

[22] Filed: Dec. 5, 1980

[51] Int. Cl.[3] ..... A24D 3/04

[52] U.S. Cl. ..... 131/336; 131/339; 131/340; 131/361; 131/362; 131/365

[58] Field of Search ..... 131/361, 362, 365, 336, 131/339, 340, 338

[56] References Cited

U.S. PATENT DOCUMENTS 3,490,461 1/1970 Osmalov et al. ..... 131/336
3,607,512 9/1971 Mathe ..... 131/340
3,910,288 10/1975 Hammersmith et al. ..... 131/340

*Primary Examiner*—V. Millin
*Attorney, Agent, or Firm*—Charles G. Lamb

[57] ABSTRACT

A filter for a cigarette includes a porous filter rod circumscribed by a smoke impervious wrapper wherein the filter rod with the smoke impervious wrapper therearound is provided with grooves embedded therein and extending from one end thereof a preselected distance longitudinally therealong. Tipping material circumscribes the smoke impervious wrapper and is provided with flow-through openings therein in flow communication with the grooves. Support means are provided for the tipping material at the mouth end of the filter to maintain the tipping material in circumferential equalization.

7 Claims, 3 Drawing Figures

CIGARETTE FILTER

BACKGROUND OF THE INVENTION

1. Field of the Invention

This invention relates to filters for cigarettes. In one aspect it relates to a filter with novel ventilating means therein. In another respect the invention relates to tipping material support means at the mouth end of a filter for a filter cigarette having flow directing grooves therein for directing ventilating air to the mouth end of a cigarette filter.

b 2. Description of the Prior Art

It is well known in the art to add filters to cigarettes wherein the filters are provided with ventilating means to bring in ambient air into the filter to dilute the smoke stream. The dilution of the smoke stream reduces the quantity of smoke particulates as well as gas phase components which are delivered to the mouth of the smoke. A number of means have been proposed and are utilized for introducing ventilating air into the cigarette. For example, the wrapper for the tobacco in a cigarette can be made from a porous material which allows for introduction of air along the entire length of the cigarette where it mixes with the smoke passing therethrough thereby diluting the smoke in the stream. Also, the cigarette wrapper may be perforated at selected locations along the length of the cigarette which provides ports for the cigarette through which ventilating air enters. Even further, it is known to perforate the wrapper of the filter on the filter end of the cigarette to allow for ventilating air to enter the filter for dilution of the smoke stream. There have also been a number of suggestions for incorporating grooves within the filter plug for the cigarette in order to facilitate the addition of ventilating air into the smoke stream.

For example, U.S. Pat. No. 3,596,663 relates to a tobacco smoke filter provided with a corrugated porous plug wrap surrounding a filter element which is circumscribed by a tipping paper having flow-through perforations therein whereby ventilating air enters directly into the filter element or progresses down the grooves to the smoker's mouth. Other patents which relate to cigarette filters having grooves circumscribing the filter element for the introduction of ventilating air into the filtering end of the filter cigarette include U.S. Pat. No. 3,577,995; U.S. Pat. No. 3,572,347; U.S. Pat. No. 3,490,461; U.S. Pat. No. 1,718,122; U.S. Pat. No. 3,788,330; U.S. Pat. No. 3,773,053; U.S. Pat. No. 3,752,165; U.S. Pat. No. 3,638,661; U.S. Pat. No. 3,608,561; and, U.S. Pat. No. 3,910,288.

SUMMARY OF THE INVENTION

The present invention advantageously provides a straight forward arrangement of an improved filter for a cigarette utilizing at least one groove in the outer periphery of a filter plug. The present invention further provides means for circumferentially equalizing air pervious tipping material at the mouth end of a cigarette filter.

Various other features of the present invention will become obvious to those skilled in the art upon reading the disclosure set forth hereinafter.

More particularly, the present invention provides a filter for a cigarette comprising a porous filter rod of cylindrical configuration; a smoke impervious wrapper extending longitudinally of and circumscribing the rod leaving flow-through opposed ends of the rod, the wrapper and rod having at least one longitudinally extending groove embedded therein, the groove extending from at least one end a preselected distance therealong; tipping material extending longitudinally of and circumscribing the wrapper, the tipping material including flow-through openings therein in flow communication with the groove; and, circumferential equalizing means for tipping material at the mouth end of the filter.

It is to be understood that the description of the examples of the present invention given hereinafter are not by way of limitation and various modifications within the scope of the present invention will occur to those skilled in the art upon reading the disclosure set forth hereinafter.

BRIEF DESCRIPTION OF THE DRAWING

Referring to the drawing.

DESCRIPTION OF THE PREFERRED EMBODIMENT

Figure 1:
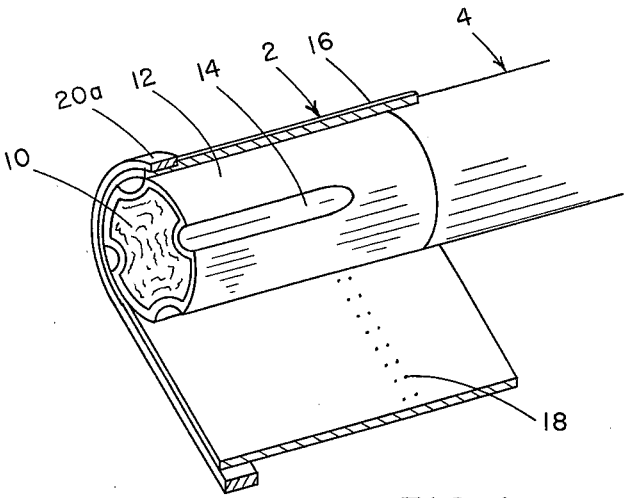
FIG. 1 is a perspective view of one preferred filter element of the present invention attached to a cigarette tobacco column with tipping material shown in an unwrapped condition.

In FIG. 1, a filter plug 2 of the present invention is shown attached to a cigarette or wrapped tobacco column 4. This filter plug 2 comprises a cellulose acetate filter element 10 or any other filter made from fibrous or foamed materials for tobacco smoke which may be known in the art circumscribed by a smoke impervious or non-porous wrapper 12. It is realized that in the use of the term "smoke impervious" or "non-porous wrapper", this includes non-porous outer surfaces of foamed material which are integral with the filter element as well as non-porous wrapping material which is not integral with the filter element. The filter plug 2 is provided with a plurality of grooves 14 therein extending longitudinally therealong. The filter plug 2 is generally prepared by taking a standard filter rod of cellulose acetate or the like, wrapping the rod with a non-porous wrapping material, then subjecting the wrapped filter rod to a mold or other treating means designed for putting appropriate grooves therein. One such method is known as a heat molding technique, which is well known in the art.

The filter plug 2 is circumscribed by tipping material 16 which includes a pair of parallel rows of ventilating perforations 18, perforations 18 being in flow-through alignment with grooves 14. The tipping material or paper 16 is attached to the outer surface of the wrapper 12 and the tobacco column 4.

Circumscribing the mouth end of the tipping paper 16 and attached to the outer surface thereof is a reinforcing or support band **20*a*. The tipping paper 16 is usually thin and flexible and the band 20*a* is disposed at the mouth end to provide means to maintain circumferential equalization during use. The reinforcing band 20*a*** may be air pervious or air impervious and may be a flexible plastic, reinforced tipping paper or any other flexible material known in the art which will enable circumferential equalization during use.

Figure 2:
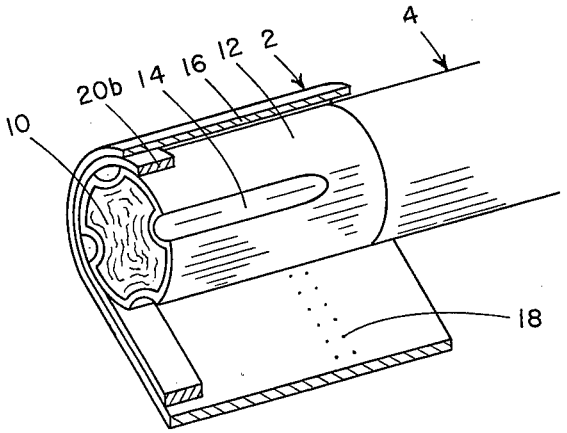
FIG. 2 is a perspective view of another preferred filter element of the present invention attached to a cigarette tobacco column with tipping material shown in an unwrapped condition; and, FIG. 3 is a perspective view of even another preferred filter element of the present invention attached to a cigarette tobacco column with tipping material shown in an unwrapped condition.

In FIG. 2, the reinforcing band 20*b* is sandwiched between the tipping paper 16 and the wrapper 12 and attached thereto.

Figure 3:
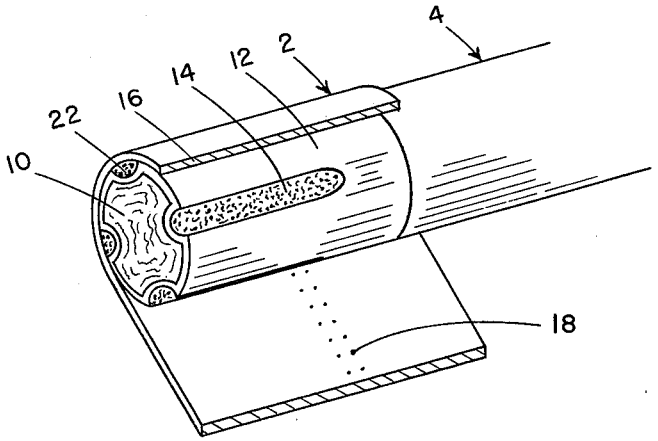

In FIG. 3, the filter plug 2 is shown with grooves 14 filled with a porous filter material 22 therein which provides for circumferential equalization at the mouth end of the filter. The porous filter material 22 may be the same material as the filter rod 10 or may be any other well known filter material known in the art. The choice of the material will be one which does not create a substantial pressure drop for the ventilating air which will flow therethrough. Furthermore, the porous filter material 22 may extend only a short distance from the mouth end instead of filling the entire groove as shown.

In use of any of the filters of FIGS. 1, 2, or 3, ventilating air passes through the air pervious tipping paper 16 and travels into the smoker's mouth through grooves 14. The circumferential equalization means, whether it be the reinforcing ring 20*a* (FIG. 1) or 20*b* (FIG. 2) or the filter media 22 (FIG. 3), maintains circumferential consistency during use.

It will be realized that various changes may be made to the specific embodiments shown and described without departing from the principles of the present invention.

What is claimed is:

1. A filter rod for a cigarette tobacco column comprising:

a porous filter rod of cylindrical configuration;

a smoke impervious wrapper extending longitudinally along said rod from one end thereof and circumscribing said rod leaving flow-through opposed ends of said rod, said wrapper having at least one longitudinally extending groove embedded into the filter rod and that portion of the wrapper defining the groove remaining smoke impervious, said groove being open ended at and extending from one of said ends a distance less than the length of the filter rod;

tipping material extending longitudinally of and circumscribing said wrapper, said tipping material being air pervious and permitting ventilating air flow therethrough into said groove, said ventilating air being the only fluid flowing through said groove when the filter is used in combination with a cigarette tobacco column during normal smoke draw; and, support means for said tipping material added at the mouth end of the filter to maintain circumferential consistency of said tipping material when in use.

2. The filter of claim 1 wherein said support means includes a reinforceable ring circumscribing the outer surface of the tipping material at the groove end of the filter.

3. The filter of claim 1 wherein said support means includes a reinforceable ring circumscribing the outer surface of the plug wrapper and attached to said wrapper and the inner surface of said tipping material, said ring being disposed at the end of the filter including the groove.

4. The filter of claim 1 wherein said support means includes a porous filter material disposed within said groove.

5. The filter of claim 1 in combination with a cigarette tobacco column, said groove of said filter being in flow communication with the smoker's mouth during normal smoke draw.

6. The filter of claim 1 wherein said tipping includes selective perforations therein in flow-communication with said groove.

7. The filter of claim 1, said smoke impervious wrapper being integral with said porous filter rod.

* * * * *